US005115991A

United States Patent [19]

Saari

[11] Patent Number: 5,115,991

[45] Date of Patent: May 26, 1992

[54] GYRATORY CONE CRUSHER

[76] Inventor: Robert S. Saari, 1002 Avenida de la Estrella, San Clemente, Calif. 92672

[21] Appl. No.: 726,238

[22] Filed: Jul. 5, 1991

[51] Int. Cl.[5] ..... B02C 2/04

[52] U.S. Cl. ..... 241/208; 241/32; 241/215; 241/216

[58] Field of Search ..... 241/207, 208, 209, 210, 241/211, 212, 213, 214, 215, 216, 32

[56] References Cited

U.S. PATENT DOCUMENTS

| | | | |
|---|---|---|---|
| 2,550,098 | 4/1951 | Traylor, Jr. | 241/209 |
| 2,833,486 | 5/1958 | MacLeod | 241/215 |
| 4,779,808 | 10/1988 | Graf | 241/30 |
| 4,787,563 | 11/1988 | Tanaka et al. | 241/208 |

FOREIGN PATENT DOCUMENTS

| | | | |
|---|---|---|---|
| 2621258 | 4/1989 | France | 241/207 |
| 0990293 | 2/1983 | U.S.S.R. | 241/207 |
| 1347974 | 10/1987 | U.S.S.R. | 241/215 |

*Primary Examiner*—Frank T. Yost
*Assistant Examiner*—John M. Husar
*Attorney, Agent, or Firm*—Stetina and Brunda

[57] ABSTRACT

The present invention relates to a gyratory cone crusher having an eccentric member mounted within a lower main frame for rotational motion relative thereto. Disposed within the eccentric member is a crusher head assembly defining a first crushing surface which is adapted to gyrate relative a second crushing surface included within an upper bowl assembly attached to the main frame. Rotation of the eccentric member is facilitated by a plurality of V-belts extending between the eccentric member and a drive motor. Disposed between head assembly and the eccentric member and the eccentric member and the main frame are first and second bronze bearings which are interfaced to a lubrication system. The present invention further comprises slideably engaged shelf members rigidly attached to the main frame and upper bowl assembly for allowing the space separating the first and second crushing surfaces to be selectively adjusted via the actuation of one or more hydraulic cylinders pivotally connected to both the main frame and bowl assembly. A length of high pressure hose is wound about the bowl assembly to provide overload relieve to the cone crusher.

20 Claims, 3 Drawing Sheets 10
12
14
16
16a
16b
17
18
18a
18b
20
22
24
25
26
28
30
32
34
36
38
39
40
42
44
46
48
50
51
52
53
54
55
56
57
58
59
60
62
64
66
68
70
72
74
76
78
80
82
84
A
B
P
4

GYRATORY CONE CRUSHER

FIELD OF THE INVENTION

The present invention relates generally to devices for crushing ore and other construction materials, and more particularly to a gyratory cone crushing mechanism.

BACKGROUND OF THE INVENTION

The use of crushing devices for crushing ore and other construction material has been well known for many years. Currently, two types of cone crushing devices are commonly utilized. The first is an inertia cone crusher as disclosed in U.S. Pat. Nos. 4,245,791 to IVANOV, ET AL.; and 4,452,401, 4,592,517 and 4,655,405 to ZAROGATSKY. ET AL. Inertia cone crushers generally comprise a crushing bowl having an inner breaking cone disposed therein in a manner defining an annular breaking cavity. The breaking cone is typically mounted on a spherical support that, along with the crushing bowl, is secured to the crusher base. Additionally, the breaking cone includes a downwardly extending shaft seated in a bearing bush which is provided with an unbalanced weight on the outer surface thereof. In operation, the inclusion of the unbalanced mass on the outer surface of the shaft causes the breaking cone to gyrate relative an outer cone disposed within the crushing bowl so as to conduct a crushing operation.

The second type of commonly used crushing device is a gyratory cone crusher Examples of gyratory cone crushers are disclosed in U.S. Pat. Nos. 2,550,098 to TRAYLOR; 4,568,031 to MITROFANOV, ET AL.; 4,589,600 to SCHUMAN; and 4,679,741 to HANSEN. The gyratory cone crushers typically comprise a rotating eccentric member supported within a crusher base via a plurality of bearing assemblies. Attached to the crusher base is a bowl assembly which includes a stationary crushing cone disposed therein. A crusher head is interfaced to the eccentric member in a manner wherein a crushing cone attached to the crusher head will gyrate relative the stationary crushing cone during rotation of the eccentric member.

With particular respect to currently-known gyratory cone crushing devices, though these crushing devices are generally suitable for conducting ore and construction material crushing operations, they possess certain inherent deficiencies which detract from their overall utility. One such deficiency relates to the drive mechanism typically associated with existing gyratory crushers. In this respect, gear and pinion assemblies are often used to interface the drive motor to the eccentric member for purposes of rotating the eccentric member. As will be recognized, these gear and pinion assemblies are susceptible to high amounts of mechanical loss and wear. Additionally, many prior art gyratory crushers incorporate numerous bearing assemblies to interface the crusher head assembly to the eccentric member and the eccentric member to the drive motor. Such bearing assemblies, due to their complexity, are prone to failure and therefore require high levels of maintenance. Additionally, these bearing assemblies add to the expense and complexity associated with the manufacture of the crushing device. Another deficiency relates to the manner in which existing gyratory crushers facilitate spacial adjustment between the crushing plates. In this respect, existing gyratory crushers generally require the placement of shims between the base and bowl assemblies of the crusher or the utilization of hydraulic systems to maintain pressure against threads of a threaded mechanism which is used to secure the bowl assembly to the base. As with the bearing, gear and countershaft assemblies, the use of these adjustment methods add significant expense and complexity to the manufacture of the device. The present invention overcomes these and other deficiencies associated with the prior art gyratory cone crushing devices.

SUMMARY OF THE INVENTION

In accordance with the preferred embodiment of the present invention, there is provided a low profile, gyratory cone crushing device. The crusher generally comprises a lower main frame having a vertical axis extending therethrough. Disposed within the main frame is a rotatably driven eccentric member. In the preferred embodiment, the eccentric member comprises a lower portion which has a generally cylindrical configuration and includes a first axis coincident with the vertical axis, and an upper portion which defines a generally cylindrical recess having a second axis oblique to the vertical axis. The crusher further comprises a crusher head assembly which is disposed within the cylindrical recess, the head assembly having a third axis coincident with the second axis whereby the head assembly will gyrate as the eccentric member rotates. Additionally, the head assembly defines a first generally conical, upwardly presented crushing surface and includes a cylindrical portion sized and configured to be receivable into the cylindrical recess of the eccentric member. Attached to the lower main frame is an upper bowl assembly which encloses the head assembly. The bowl assembly includes an inlet opening located generally over the head assembly and a second generally conical crushing surface spaced from the first crushing surface. The second crushing surface is generally fixed in position relative the eccentric member such that material introduced into the cone crusher through the inlet will be crushed in the space between the first and second crushing surfaces.

Disposed adjacent the lower main frame is a drive motor which includes a drive shaft extending downwardly therefrom. Additionally, attached to the lower portion of the eccentric member is a pulley. In the preferred embodiment, at least one horizontally oriented V-belt is used to connect the drive shaft to the pulley in a manner wherein rotation of the drive shaft causes the simultaneous rotation of the eccentric member. Advantageously, the main frame comprises a pair of hollow spokes disposed therein which are sized and configured to receive and cover the V-belt within the main frame. The main frame further includes a spacer member releasably attached thereto between the hollow spokes for facilitating removal and installation of the V-belt.

The gyratory cone crusher of the present invention further comprises a first bronze bearing attached to the main frame in a manner wherein the first bearing is mounted between the main frame and the upper portion of the eccentric member. The first bearing, which defines a fourth axis coincident with the vertical axis, is operable to transmit thrust loads and radial loads from the eccentric member to the main frame and enable the eccentric member to rotate within the main frame. Also included is a second bronze bearing which is disposed within the recess of the eccentric member in a manner wherein the second bearing is mounted between the eccentric member and the cylindrical portion of the head assembly. The second bearing, which defines a fifth axis coincident with the second axis, is operable to transmit thrust loads and radial loads from the head assembly to the eccentric member.

The preferred gyratory cone crusher further comprises means for lubricating the first bronze bearing and the second bronze bearing. In the preferred embodiment, the lubricating means comprises a lubricating fluid feed line which is fluidly connected to a first circumferential lubrication groove disposed within the upper portion of the eccentric member and adapted to feed lubricating fluid between the upper portion and the first bearing. The first lubrication groove is fluidly connected, via a first fluid duct disposed within the eccentric member, to a second circumferential lubrication groove which is also disposed within the upper portion of the eccentric member and adapted to feed lubricating fluid between the cylindrical portion of the head assembly and the second bearing. A second fluid duct disposed within the eccentric member is included for channeling excess lubricating fluid from the radial load transmitting surface of the second bearing to an orificed lubricating fluid drain line. In the preferred embodiment, the upper portion of the eccentric member includes a labyrinth dust seal formed about the periphery thereof. The dust seal, in addition to preventing contaminants from entering the space between the eccentric member and the first and second bearings, is also operable to divert excess lubricating fluid from the thrust load transmitting surface of the second bearing and the radial load transmitting surface of the first bearing to the drain line. The lubrication system of the present invention is further adapted to apply hydraulic pressure to the head assembly in a manner operable to upwardly bias the head assembly against the bowl assembly when no material is placed within the crusher during operation thereof. The contact between the head assembly and the bowl assembly prevents the high speed rotation of the head assembly thereby preventing damage to the cone crusher from occurring.

In the preferred embodiment, the first crushing surface and the second crushing surface each include a wear member attached thereto. The first wear member attached to the first crushing surface has a generally conical configuration and is constructed from an alloy steel. The second wear member attached to the second crushing surface is likewise constructed from alloy steel and is formed to include at least one portion sized and configured to define and oversized opening between the first and second wear members during operation of the cone crusher. This enlarged portion allows oversized material introduced into the inlet of the bowl assembly to be pulled between the wear members and subsequently passed through the space defined therebetween.

The cone crusher of the present invention further comprises means for adjusting the size of the space defined between the first and second crushing surfaces and more particularly, the first and second wear members. In the preferred embodiment, the adjusting means comprises a first inclined shelf attached to an outer surface of the main frame. Cooperatively engaged to the first shelf are a pair of inclined shelves which are attached to the bowl assembly. Pivotally connected to the main frame is at least one hydraulic cylinder which includes a rod extending outwardly therefrom having a distal end pivotally connected to the bowl assembly. When the cylinder rod is actuated in an outward direction, the space between the first and second wear member is increased via the upward sliding of the shelf pair relative the first shelf. In contrast, when the cylinder rod member is inwardly actuated the space between the first and second wear members is decreased due to the downward sliding of the shelf pair relative the first shelf.

The gyratory crusher of the present invention also comprises means for providing overload relief when uncrushable extraneous material is introduced thereinto. The preferred relief means comprises a length of high pressure hose which is wound about the bowl assembly in a manner defining a plurality of vertically aligned rows. Disposed between each row are plates which are used to provide uniform bearing under load. As an alternative to the high pressure hose, the relief means may comprise one or more pneumatic cylinders attached to the bowl assembly.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

The detailed description set forth below in connection with the appended drawings is intended merely as a description of the presently preferred embodiments of the invention, and is not intended to represent the only form in which the present invention may be constructed or utilized. The description sets forth the functions and sequence of steps for construction and implementation of the invention in connection with the illustrated embodiments. It is to be understood, however, that the same or equivalent functions and sequences may be accomplished by different embodiments that are also intended to be encompassed within the spirit and scope of the invention.

Figure 1:
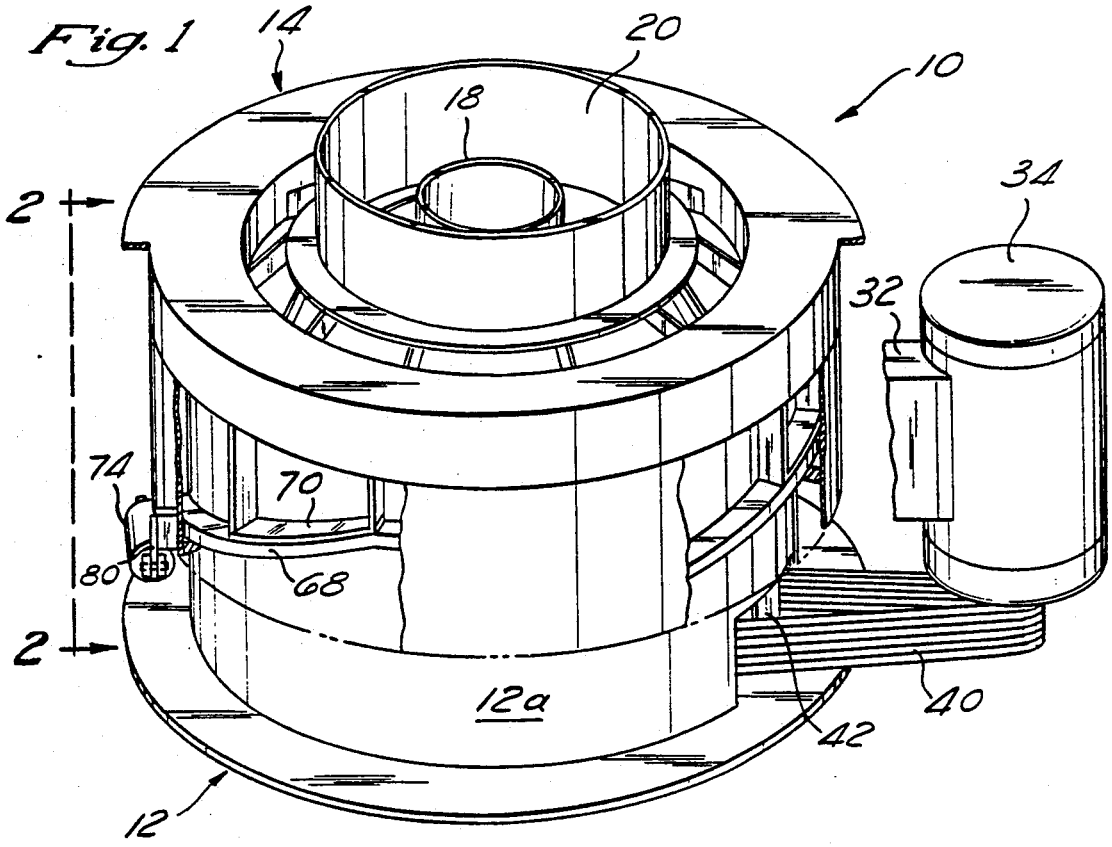
FIG. 1 is a perspective view of the gyratory cone crusher of the present invention.

Referring now to the drawings, FIG. 1 perspectively illustrates the gyratory cone crusher 10 constructed in accordance with the preferred embodiment of the present invention. In the preferred embodiment, cone crusher 10 generally comprises a lower main frame 12 having a main vertical axis A—A extending therethrough. Rigidly attached to main frame 12 is an upper bowl assembly 14.

Figure 3:
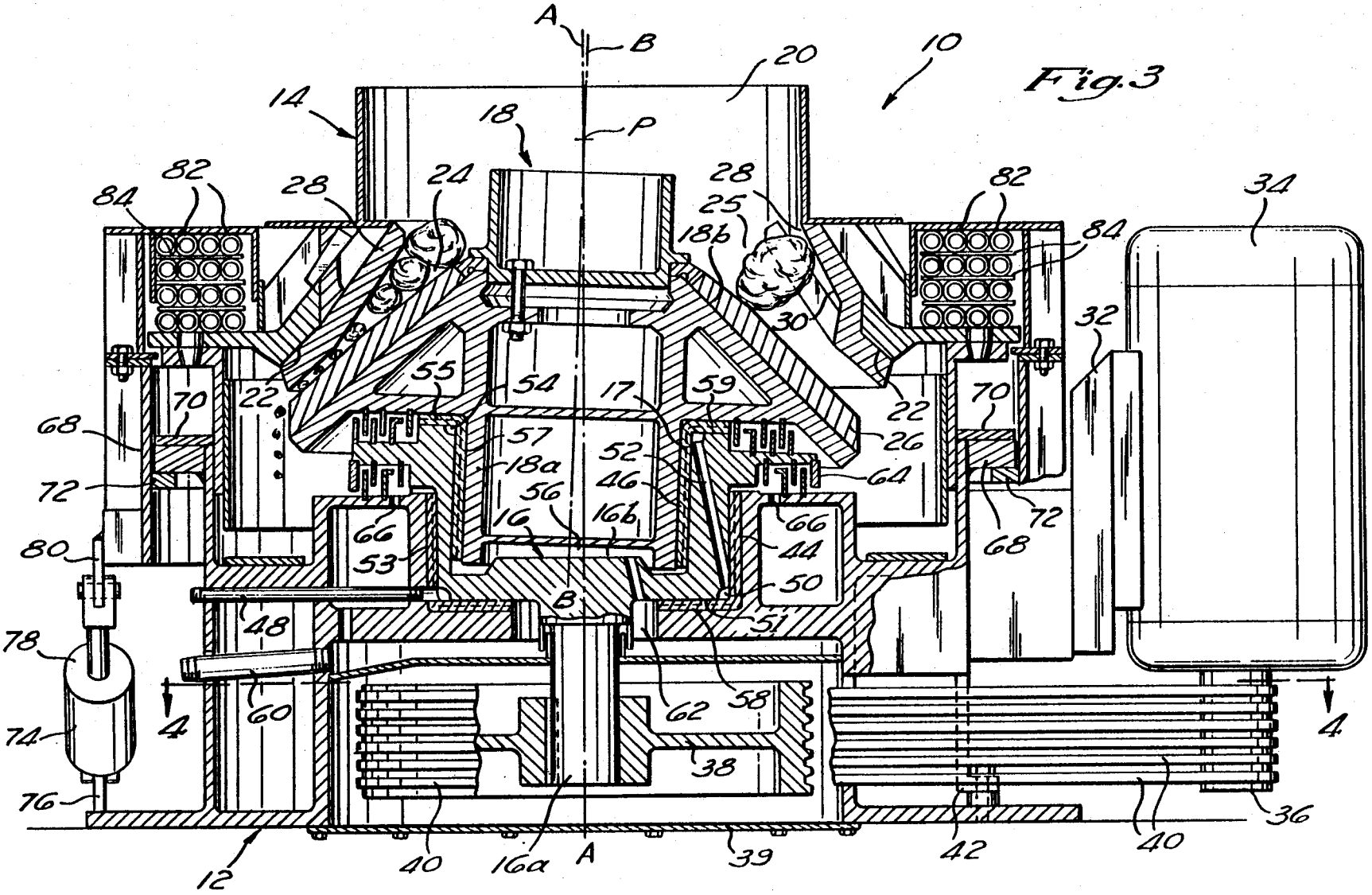
FIG. 3 is a cross-sectional view of the present invention.

Referring now to FIG. 3, disposed within main frame 12 is a rotatably driven eccentric member 16. In the preferred embodiment, eccentric member 16 comprises a lower portion 16*a* having a general cylindrical configuration and including a first axis coincident with vertical axis A—A. Eccentric member 16 further comprises an upper portion 16*b* defining a generally cylindrical recess 17 having a second axis B—B oblique to vertical axis A—A. Disposed within the cylindrical recess of the eccentric member 16 is a crusher head assembly 18 having a third axis coincident with the second axis B—B of the recess 17. As will be recognized, because cf its offset orientation, the head assembly 18 will gyrate relative a focal point P when the eccentric member 16 rotates. In the preferred embodiment, head assembly 18 includes a cylindrical portion 18*a* sized and configured to be receivable into the recess 17 of the eccentric member 16, and defines a first generally conical, upwardly presented crushing surface 18*b*. Importantly, upper bowl assembly 14 is attached to main frame 12 in a manner enclosing the head assembly 18. In this respect, the bowl assembly 14 includes an inlet opening 20 located generally over the head assembly 18. Additionally, the bowl assembly 14 includes a second generally conical crushing surface 22 which is spaced from the first crushing surface 18*b* of head assembly 18. In the preferred embodiment, the second crushing surface 22 is adapted to be generally fixed in position relative to the eccentric member 16 such that material introduced into the cone crusher 10 via the inlet opening 20 will be crushed in the space 24 between the first crushing surface 18*b* and the second crushing surface 22 during rotation of the eccentric member 16.

Attached to the first crushing surface 18*b* is a first wear member 26 having a generally conical configuration. In the preferred embodiment, first wear member 26 is constructed from alloy steel. Additionally, attached to the second crushing surface 22 is a second wear member 28 which, like first wear member 26, is also preferably constructed from alloy steel. In the preferred embodiment, second wear member 18 is formed to include a stepped portion 30 therein which is sized and configured to define an oversized opening 25 between first wear member 26 and second wear member 28 during operation of the cone crusher 10. Advantageously the oversized opening 25 allows oversized material introduced into the inlet opening 20 to be pulled between the wear members 26 and 28 due to the head creep of the head assembly 18 and subsequently crushed during operation of the cone crusher 10.

To facilitate the rotation of the eccentric member 16 within the main frame 12, attached to the main frame 12 via a mount 32 is a drive motor 34. Extending downwardly from drive motor 34 is a drive shaft 36. Additionally, rigidly attached to the distal end of the lower portion 16*a* of eccentric member 16 is a pulley 38. In the preferred embodiment, a plurality of horizontally oriented V-belts 40 are used to connect the drive shaft 36 to the pulley 38 in a manner wherein rotation of the drive shaft 36 causes the simultaneous rotation of the eccentric member 16. As will be recognized, the use of the vertically oriented drive motor 34 in conjunction with the pulley 38 and V-belts 40 eliminates the need for a gear, shaft and pinion assembly as is often utilized in conjunction with prior art gyratory cone crushing devices. In this regard, the wear problems and mechanical losses typically associated with gear and pinion assemblies is eliminated through the utilization of the V-belts 40. As seen in FIG. 3, the pulley 38 is enclosed within the main frame 12 via a dust cover 39.

Figure 4:
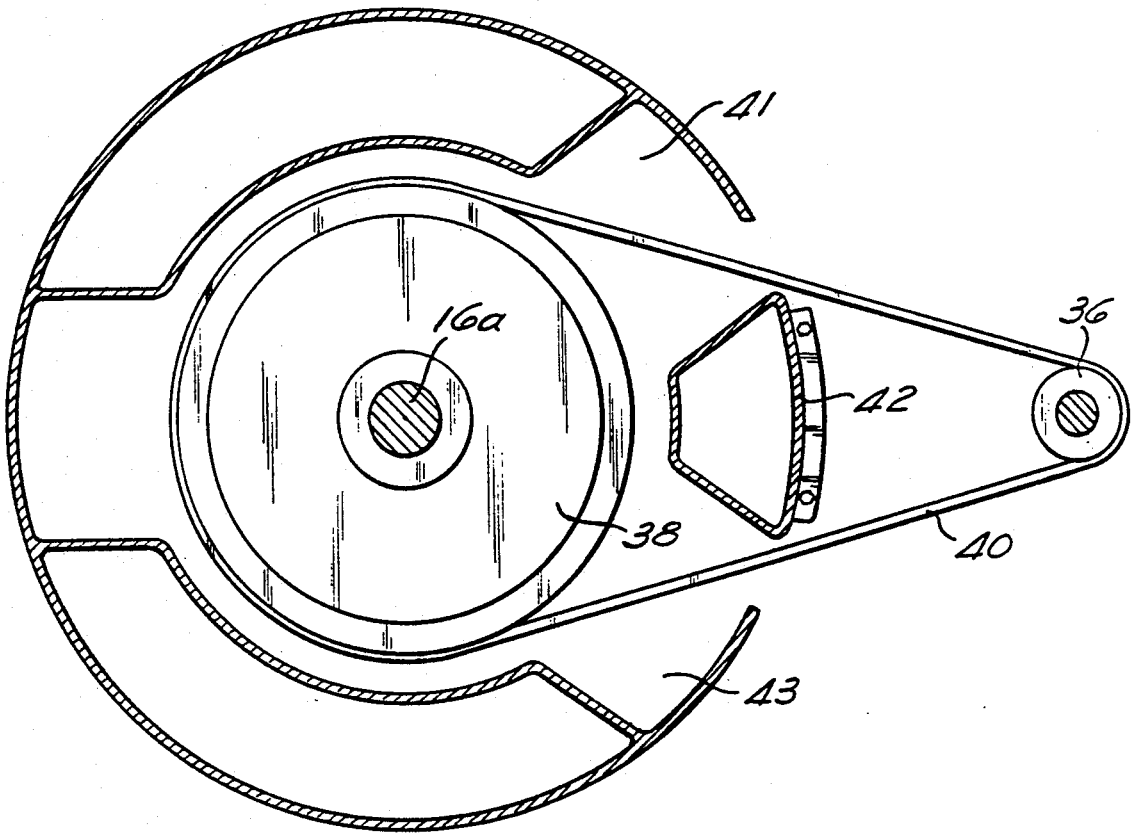
FIG. 4 is a top view of the present invention taken along line 4—4 of FIG. 3.

Referring now to FIG. 4, disposed within the main frame 12 are a pair of hollow spokes 41, 43 which are sized and configured to receive and cover the V-belts 40 within the main frame 12. Advantageously, the use of the hollow spokes 41, 43 in conjunction with the V-belts 40 reduces the height of crushed material build up on the spokes 41, 43. To facilitate the removal or installation of the V-belts 40, the main frame 12 further comprises a spacer member 42 releasably attached to the main frame 12 between the hollow spokes 41, 43. In this respect, removal of the spacer member 42 from the main frame 12 allows the V-belt 40 to be installed upon the pulley 38 or removed therefrom. When spacer member 42 is reinserted between the hollow spokes 41, 43, the structural strength of the main frame 12 is fully restored. Additionally, to aid in the removal or installation of the V-belt 40 upon the pulley 38 and drive shaft 36, mount 32 is adapted to allow drive motor 34 to slide horizontally. As can be appreciated, such horizontal positioning is also used for the adjustment and tensioning of V-belt 40.

The gyratory cone crusher 10 of the present invention further comprises a first bronze bearing 44 attached to the main frame 12 in a manner wherein first bearing 44 is mounted between the main frame 12 and the upper portion 16*b* of the eccentric member 16. The first bearing 44 defines a fourth axis coincident with the vertical axis A—A of main frame 12 and is operable to transmit thrust loads and radial loads from the eccentric member 16 to the main frame 12 and enable the eccentric member 16 to rotate within the main frame 12. A second bronze bearing 46 is disposed within the recess 17 defined within the eccentric member 16 in a manner wherein second bearing 46 is mounted between the eccentric member 16 and the cylindrical portion 18*a* of crusher head assembly 18. Second bearing 46 defines a fifth axis coincident with the second axis B—B and is operable to transmit thrust loads and radial loads from the head assembly 18 to the eccentric member 16.

To maintain a sliding interface between the eccentric member 16 and first bronze bearing 44 and the head assembly 18 and the second bronze bearing 46, the cone crusher 10 of the present invention includes a bearing lubrication system. In the preferred embodiment, the lubrication system comprises a lubricating fluid feed line 48 which is interfaced to a lubricating fluid source. Feed line 48 is fluidly connected to a first circumferential lubrication groove 50 disposed within the upper portion 16*b* of the eccentric member 16. First lubrication groove 50 is adapted to feed lubricating fluid between the upper portion 16*b* of the eccentric member 16 and the first bearing 44 via a first radial groove 51 disposed within first bearing 44 for channeling fluid to the thrust load transmitting surface thereof and a first longitudinal groove 53 disposed within first bearing 44 for channeling fluid to the radial load transmitting surface thereof. Disposed within the upper portion 16*b* of the eccentric member 16 is a first fluid duct 52. First fluid duct 52 is operable to fluidly connect the first lubrication groove 50 to a second circumferential lubrication groove 54 which is also disposed within the upper portion 16*b* of the eccentric member 16. Second lubrication groove 54 is adapted to feed lubricating fluid between the cylindrical portion 18*a* of the head assembly 18 and the second bearing 46 via a second radial groove 55 disposed within second bearing 46 for channeling fluid to the thrust load transmitting surface thereof and a second longitudinal groove 57 disposed within second bearing 46 for channeling fluid to the radial load transmitting surface thereof. In the preferred embodiment, fluid entering first groove 50 via feed line 48 will subsequently flow into second groove 54 via first duct 52. Fluid flows from second groove 54 into the second radial groove 55 and second longitudinal groove 57 via an opening 59 formed within second bearing 46. In the preferred embodiment, excess lubricating fluid from the vertical radial load transmitting surface of the second bearing 46 flows downwardly into a gap 56 formed between the cylindrical portion 18*a* of the crusher head 18 and the upper portion 16*b* of the eccentric member 16. Such excess lubricating fluid is drained from within gap 56 via a second fluid duct 58 disposed within the upper portion 16*b* of eccentric member 16. After being drained via second fluid duct 58, the excess lubricating fluid flows through an opening 62 formed between the main frame 12 and lower portion 16*a* of eccentric member 16, and is removed from the main frame 12 via an orificed lubricating fluid drain line 60. Excess lubricating fluid applied to the horizontally oriented thrust load transmitting surface of the first bearing 44 is also channeled through opening 62 and subsequently removed via drain line 60.

Disposed about the periphery of the upper portion 16*b* of eccentric member 16 is a labyrinth dust seal 64. In addition to preventing contaminants from entering the bearing surfaces of first and second bearings 44 and 46, dust seal 64 is operable to divert excess lubricating fluid from the horizontal trust load transmitting surface of the second bearing 46 through an outlet port 66 which channels the fluid to the drain line 60. Additionally, excess lubricating fluid from the vertical radial load transmitting surface of first bearing 44 is diverted by the dust seal 64 through the outlet port 66 and into the drain line 60. Thus, the aforementioned lubrication system serves to constantly lubricate the bearing surfaces of the first and second bearings 44 and 46 while continuously allowing excess lubricating fluid to be drained from and recirculated into the cone crusher 10 via the drain line 60 and feed line 48. It is further contemplated that second fluid duct 58 may be adapted to be selectively opened and closed so as to allow lubricating fluid to build up within gap 56 when in the closed position. The build up of lubricating fluid within gap 56 is operable to apply upward hydraulic pressure to the head assembly 18 thus causing cylindrical portion 18*a* to slide upwardly within recess 17. This upward movement is limited by the eventual abutment of first wear member 26 against second wear member 28. It is contemplated that second fluid duct 58 will be automatically closed in those instances when cone crusher 10 is operating, but no material is being introduced thereinto. As such, the abutment of first wear member 26 against the second wear member 28 will prevent any damage from occurring to the cone crusher 10 attributable to the high speed rotation of head assembly 18.

Figure 2:
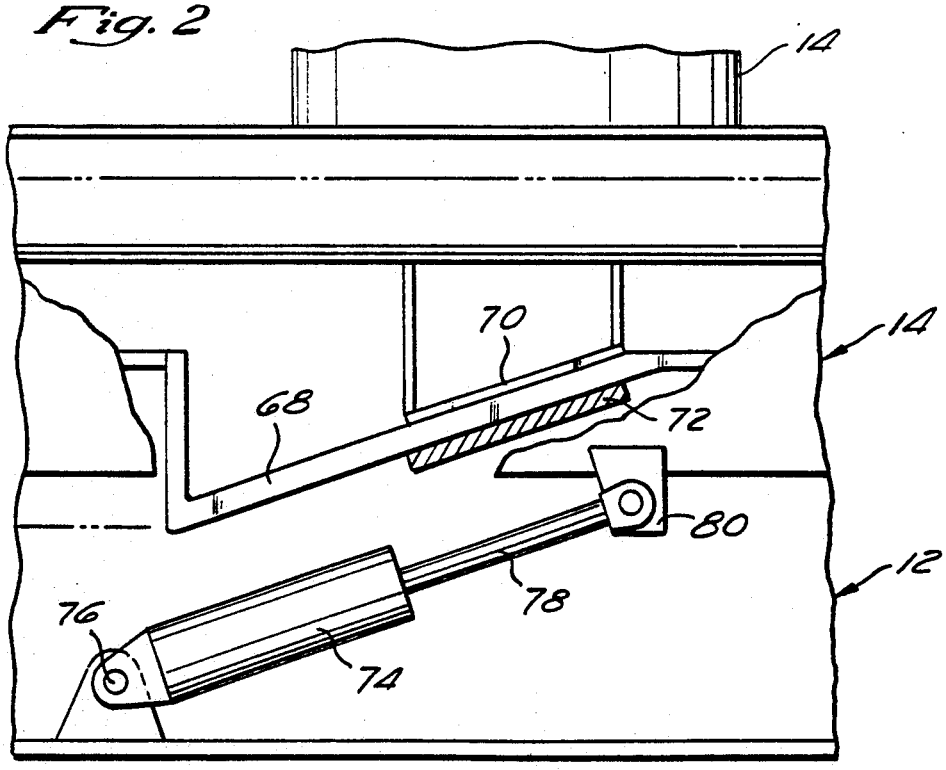
FIG. 2 is a partial side view of the present invention taken along line 2—2 of FIG. 1.

Referring now to FIGS. 1–3, the cone crusher 10 of the present invention further includes a mechanism for adjusting the distance separating the first wear member 26 and the second wear member 28. In the preferred embodiment, the adjusting mechanism comprises a first inclined shelf 68 attached to the outer surface 12*a* of main frame 12. Disposed on each side of and slideably engaged to inclined shelf 68 are a top bowl shelf 70 and a bottom bowl shelf 72 which are rigidly attached to the upper bowl assembly 14. Bowl shelves 70 and 72 are sized and configured to be concurrently moveable relative shelf 68. To facilitate the simultaneous sliding movement of the shelves 70 and 72 relative inclined shelf 68, pivotally connected to main frame 12 are one or more hydraulic cylinders 74. The pivotal connection of cylinder 74 to main frame 12 is facilitated by a pivot bracket 76. Extending outwardly from hydraulic cylinder 74 is a cylinder rod 78 having a distal end pivotally connected to upper bowl assembly 14 via a pivot bracket 80. As best seen in FIG. 2, when rod 78 is actuated outwardly, i.e. away from pivot bracket 76, shelves 70 and 72 are caused to slide upwardly relative inclined shelf 68. As will be recognized, this upward movement of the shelves 70 and 72 causes the bowl assembly 14 to move upwardly relative main frame 12 thereby increasing the distance separating first wear member 26 and second wear member 28. Conversely, the inward actuation of rod 78, i.e. toward pivot bracket 76, causes shelves 70 and 72 to slide downwardly along inclined shelf 68 thereby causing upper bowl assembly 14 to move downwardly relative main frame 12. This downward movement serves to decrease the distance separating wear members 26 and 28.

The gyratory cone crusher 10 of the present invention further comprises an assembly for providing overload relief to the cone crusher 10 when uncrushable extraneous material is introduced thereinto via the inlet opening 20. In the preferred embodiment, the overload relief assembly comprises a length of high pressure hose 82 which is wound about the upper bowl assembly 14. As best seen in FIG. 3, the high pressure hose 82 is wound about bowl assembly 14 so as to define a plurality of vertically aligned rows. Importantly, disposed between each of the rows of high pressure hose 82 are plates 84 which are used to provide uniform bearing under load. In the preferred embodiment, during operation of the cone crusher 10, the high pressure hose 82 is filled with compressed air. If a piece of uncrushable material falls between wear members 26 and 28, second wear member 26 and hence upper bowl assembly 14 will be forced upwardly against the high pressure hose 82 thereby allowing the uncrushable material to pass between the wear members 26 and 28. Though not shown, it will be recognized that conventional pneumatic cylinders or hydraulic cylinders may be utilized as an alternative to the high pressure hose 82 shown and described.

What is claimed is:

1. A low profile gyratory cone crusher comprising:

a lower main frame having a vertical axis extending therethrough;

a rotatably driven eccentric member disposed within said main frame, said eccentric member comprising:

(a) a lower portion having a generally cylindrical configuration and including a first axis coincident with said vertical axis; and (b) an upper portion defining a generally cylindrical recess having a second axis oblique to said vertical axis;

a crusher head assembly disposed within said recess, said head assembly having a third axis coincident with said second axis whereby said head assembly will gyrate as the eccentric member rotates, said head assembly defining a first generally conical upwardly presented crushing surface and including a cylindrical portion sized and configured to be receivable into said recess;

an upper bowl assembly attached to said main frame in a manner enclosing said head assembly, said bowl assembly having an inlet opening located generally over said head assembly and a second generally conical crushing surface spaced from the first crushing surface, said second crushing surface being generally fixed in position relative said eccentric member such that material introduced into the cone crusher through the inlet will be crushed in the space between the first and second crushing surfaces;

a first bearing attached to said main frame so as to be mounted between said main frame and the upper portion of said eccentric member, said first bearing having a fourth axis coincident with said vertical axis and including a first horizontal portion for transmitting thrust loads from the eccentric member to the main frame and a first vertical portion for transmitting radial loads from the eccentric member to the main frame, said first bearing member enabling the eccentric member to rotate within the main frame; and a second bearing disposed within said recess so as to be mounted between said eccentric member and the cylindrical portion of said head assembly, said second bearing having a fifth axis coincident with said second axis and including a second horizontal portion for transmitting thrust loads from the head assembly to the eccentric member and a second vertical portion for transmitting radial loads from the head assembly to the eccentric member.

2. The device of claim 1 further comprising means for lubricating said first bronze bearing and said second bronze bearing.

3. The device of claim 2 wherein said lubricating means comprises:

a lubricating fluid feed line;

a first radial groove disposed with said first horizontal portion of said first bearing;

a first longitudinal groove disposed within said first vertical portion of said first bearing;

a second radial groove disposed within said second horizontal portion of said second bearing;

a second longitudinal groove disposed within said second vertical portion of said second bearing;

a first circumferential lubrication groove disposed within the upper portion of the eccentric member for feeding lubricating fluid between the upper portion and the first horizontal portion of said first bearing via said first radial groove and between the upper portion and said first vertical portion of said first bearing via said first longitudinal groove, said feed line being fluidly connected to said first groove;

a second circumferential lubrication groove disposed within the upper portion of the eccentric member for feeding lubricating fluid between the cylindrical portion of the head assembly and the second horizontal portion of said second bearing via said second radial groove and between the cylindrical portion of the head assembly and the second vertical portion of said second bearing via said second longitudinal groove;

a first fluid duct disposed within the upper portion of said eccentric member, said first duct being operable to fluidly connect said first groove to said second groove;

an orificed lubricating drain line; and a second fluid duct disposed within the upper portion of said eccentric member for channeling excess lubricating fluid from the second longitudinal groove of the second bearing to said drain line.

4. The device of claim 3 wherein the upper portion of said eccentric member includes a labyrinth dust seal formed about the periphery thereof, said seal being operable to divert excess lubricating fluid from the second radial groove of said second bearing and the first longitudinal groove of the first bearing to said drain line.

5. The device of claim 1 further comprising:

a first wear member attached to said first crushing surface, said first wear member having a generally conical configuration; and a second wear member attached to said second crushing surface.

6. The device of claim 5 wherein said second wear member includes at least one stepped portion formed therewithin, said stepped portion being sized and configured to define an oversized opening between the first and second wear members during operation of the cone crusher to allow oversized material introduced into the inlet to be pulled between the wear members.

7. The device of claim 6 wherein said first and second wear members are constructed from alloy steel.

8. The device of claim 1 further comprising:

a drive motor disposed adjacent said main frame, said drive motor including a drive shaft extending downwardly therefrom;

a pulley attached to the lower portion of said eccentric member; and at least one horizontally oriented V-belt connecting said drive shaft to said pulley in a manner wherein rotation of said drive shaft causes the simultaneous rotation of said eccentric member.

9. The device of claim 8 wherein said main frame comprises a pair of hollow spokes disposed therein, said spokes being sized and configured to receive and cover said V-belt within the main frame.

10. The device of claim 9 wherein said main frame further comprises a spacer member releasably attached thereto between said hollow spokes for facilitating removal and installation of said V-belt.

11. The device of claim 1 further comprising means for adjusting the spacial distance separating the first and second crushing surfaces.

12. The device of claim 11 wherein said adjusting means comprises:

a first inclined shelf attached to an outer surface of said main frame;

a pair of bowl shelves attached to said bowl assembly, said bowl shelves being slideably engaged to said first shelf; and at least one hydraulic cylinder pivotally connected to said main frame, said cylinder including a rod extending outwardly therefrom having a distal end pivotally connected to said bowl assembly;

wherein actuation of said rod in a first direction causes the distance separating said first and second crushing surfaces to increase and actuation of said rod in a second direction causes the distance separating said first and second crushing surfaces to decrease.

13. The device of claim 1 further comprising means for providing overload relief to said cone crusher when rushable extraneous material is introduced thereinto.

14. The device of claim 13 wherein said relief means comprises a length of high pressure hose wound about said bowl assembly in a manner forming a plurality of vertically aligned rows, said rows including plates therebetween for providing uniform bearing under load.

15. The device of claim 13 wherein said relief means comprises at least one pneumatic cylinder attached to said bowl assembly.

16. The device of claim 1 wherein only said first bearing and said second bearing are included for transmitting thrust loads and radial loads from said head assembly to said main frame.

17. A low profile gyratory cone crusher comprising:

a lower main frame having a vertical axis extending therethrough;

a rotatably driven eccentric member disposed within said main frame, said eccentric member comprising:

(a) a lower portion having a generally cylindrical configuration and including a first axis coincident with said vertical axis; and (b) an upper portion defining a generally cylindrical recess having a second axis oblique to said vertical axis;

a head assembly disposed within said recess, said head assembly having a third axis coincident with said second axis whereby said head assembly will gyrate as the eccentric member rotates, said head assembly defining a first generally conical upwardly presented crushing surface and including a cylindrical portion sized and configured to be receivable into said recess;

an upper bowl assembly attached to said main frame in a manner enclosing said head assembly, said bowl assembly having an inlet opening located generally over said head assembly and a second generally conical crushing surface spaced from the first crushing surface, said second crushing surface being generally fixed in position relative said eccentric member such that material introduced into the cone crusher through the inlet will crushed int eh space between the first and second crushing surfaces;

a first bearing attached to said main frame so as to be mounted between said main frame and the upper portion of said eccentric member, said first bearing having a fourth axis coincident with said vertical axis; and a second bearing disposed within said recess so as to be mounted between said eccentric member and the cylindrical portion of said head assembly, said second bearing having a fifth axis coincident with said second axis;

said first bearing and said second bearing being specifically configured to transmit thrust loads and radial loads from said head assembly to said main frame.

18. The device of claim 17 wherein said first bearing is sized and configured to transmit thrust loads and radial loads from said eccentric member to said main frame and said second bearing is sized and configured to transmit thrust loads and radial loads from said head assembly to said eccentric member.

19. The device of claim 18 wherein only said first bearing and said second bearing are included for transmitting thrust loads and radial loads from said head assembly to said main frame.

20. A low profile gyratory cone crusher comprising:

a lower main frame having a vertical axis extending therethrough;

a rotatably driven eccentric member disposed within said main frame, said eccentric member comprising:

(a) a lower portion having a generally cylindrical configuration and including a first axis coincident with said vertical axis; and (b) an upper portion defining a generally cylindrical recess having a second axis oblique to said vertical axis;

a head assembly disposed within said recess, said head assembly having a third axis coincident with said second axis whereby said head assembly will gyrate as the eccentric member rotates, said head assembly defining a first generally conical upwardly presented crushing surface and including a cylindrical portion sized and configured to be receivable into said recess;

an upper bowl assembly attached to said main frame in a manner enclosing said head assembly, said bowl assembly having an inlet opening located generally over said head assembly and a second generally conical crushing surface spaced from the first crushing surface, said second crushing surface being generally fixed in position relative said eccentric member such that material introduced into the cone crusher through the inlet will crushed in the space between the first and second crushing surfaces; and a bearing assembly interfaced to said eccentric member, said bearing assembly being configured to enable said eccentric member to rotate within said main frame and to transmit thrust loads and radial loads from said head assembly to said main frame.

* * * * *